US006866177B1

(12) United States Patent
Chen

(10) Patent No.: US 6,866,177 B1
(45) Date of Patent: Mar. 15, 2005

(54) DEPTH CONTROL DEVICE FOR A FASTENER DRIVING TOOL

(75) Inventor: Robert Chen, Taichung Hsien (TW)

(73) Assignee: Panrex Industrial Co., Ltd. (TW)

( * ) Notice: Subject to any disclaimer, the term of this patent is extended or adjusted under 35 U.S.C. 154(b) by 0 days.

(21) Appl. No.: 10/732,335

(22) Filed: Dec. 9, 2003

Related U.S. Application Data

(60) Provisional application No. 60/498,873, filed on Aug. 29, 2003.

(51) Int. Cl.[7] ..... B25C 7/00
(52) U.S. Cl. ..... 227/142; 227/8
(58) Field of Search ..... 227/142, 8

(56) References Cited

U.S. PATENT DOCUMENTS 5,219,110 A * 6/1993 Mukoyama ..... 227/8
5,385,286 A 1/1995 Johnson, Jr. ..... 227/8
5,564,614 A * 10/1996 Yang ..... 227/142
5,667,127 A * 9/1997 Ichikawa et al. ..... 227/142
6,695,192 B1 * 2/2004 Kwok ..... 227/8
6,783,044 B2 * 8/2004 Perra et al. ..... 227/8
2002/0121540 A1 * 9/2002 Taylor et al.
2004/0149800 A1 * 8/2004 Perra et al.

* cited by examiner

*Primary Examiner*—Scott A. Smith
*Assistant Examiner*—Brian Nash
(74) *Attorney, Agent, or Firm*—Ostrolenk, Faber, Gerb & Soffen, L

(57) ABSTRACT

A depth control device includes a linkage connected to and movable with a contact element of a driving tool. A cam follower is connected to the linkage so as to be movable together therewith between first and second longitudinal positions relative to a cam when the contact element is disposed at anon-actuated position. The cam is connected to a driving member which is operable to drive the cam to move in a transverse direction relative to a longitudinal direction, and engages slidingly the cam follower so as to permit movement of the cam follower between first and second longitudinal positions.

7 Claims, 8 Drawing Sheets

DEPTH CONTROL DEVICE FOR A FASTENER DRIVING TOOL

CROSS REFERENCE TO RELATED APPLICATION

This application claims priority of New U.S. Provisional Patent Application No. 60/498,873 of the applicant for "Depth Adjusting Device for Nail Driving Gun", which was filed on Aug. 29, 2003.

BACKGROUND OF THE INVENTION

1. Field of the Invention

The present invention relates to a depth control device, more particularly to a depth control device for a powered fastener driving tool. The depth control device can be easily operated to adjust the depth of penetration of a fastener into a workpiece.

2. Description of the Related Art

In U.S. Pat. No. 5,385,286, there is disclosed an adjustable depth control which includes an upper safety rod, a lower safety rod, and a coupling that couples the upper and lower safety rods together. The upper safety rod is rigidly affixed to the coupling to prohibit linear motion relative to the coupling. The bottom side of the coupling has a lower cam face that is spring-biased against a spacer, thereby preventing the coupling from rotating. The spacer is formed with an upper cam face in sliding contact with the lower cam face of the coupling. The lower safety rod is connected threadedly to the coupling.

Some disadvantages of the aforesaid adjustable depth control for a driving tool are as follows:

(1) It is relatively inconvenient to adjust the depth of a fastener into a workpiece, because the user needs to hold the lower safety rod with one hand while rotating the coupling with the other hand to move the lower safety rod relative to the coupling; and (2) The spring for biasing the spacer against the coupling so as to prevent rotation of the coupling may suffer from spring fatigue after a long term of use so that the coupling cannot be firmly retained.

SUMMARY OF THE INVENTION

Therefore, the object of this invention is to provide a depth control device for a driving tool which is capable of overcoming the aforesaid disadvantages of the aforesaid adjustable depth control.

According to the present invention, a depth control device is used in a fastener driving tool that includes a trigger, an actuator disposed movably therein and associated with the trigger for actuating the driving tool upon pulling of the trigger, a fastener guiding body, and a workpiece contact element associated with the actuator and movable relative to the fastener guiding body in a longitudinal direction between a non-actuated position, in which the driving tool cannot be actuated by the actuator upon pulling of the trigger, and an actuated position, in which the driving tool is actuated by the actuator upon pulling of the trigger. The depth control device accordingly includes: a linkage adapted to be connected to the workpiece contact element so as to be movable together therewith in the longitudinal direction; a driving member; a cam unit adapted to be mounted in the driving tool and including a cam that defines a first cam face, and a cam follower that defines a second cam face, the cam follower being connected to the linkage so as to be movable together with the linkage and the workpiece contact element in the longitudinal direction between first and second longitudinal positions relative to the cam when the workpiece contact element is disposed at the non-actuated position, the cam being connected to the driving member, which is operable to drive the cam to move in a transverse direction relative to the longitudinal direction between first and second transverse positions relative to the cam follower, the first and second cam faces engaging each other slidingly and in such a manner as to permit movement of the cam follower together with the linkage and the workpiece contact element between the first longitudinal position and the second longitudinal position when the cam is driven by the driving member to move between the first transverse position and the second transverse position, the cam follower being movable together with the linkage, the cam and the driving member from an adjusted position between the first and second longitudinal positions to a third longitudinal position in the longitudinal direction upon movement of the workpiece contact element from the non-actuated position to the actuated position; and a push member adapted to contact the actuator and associated with the cam in such a manner as to be movable together therewith in the longitudinal direction upon movement of the workpiece contact element between the non-actuated position and the actuated position.

BRIEF DESCRIPTION OF THE DRAWINGS

Other features and advantages of this invention will become more apparent in the following detailed description of the preferred embodiment of this invention, with reference to the accompanying drawings, in which.

DETAILED DESCRIPTION OF THE PREFERRED EMBODIMENT

Figure 1:
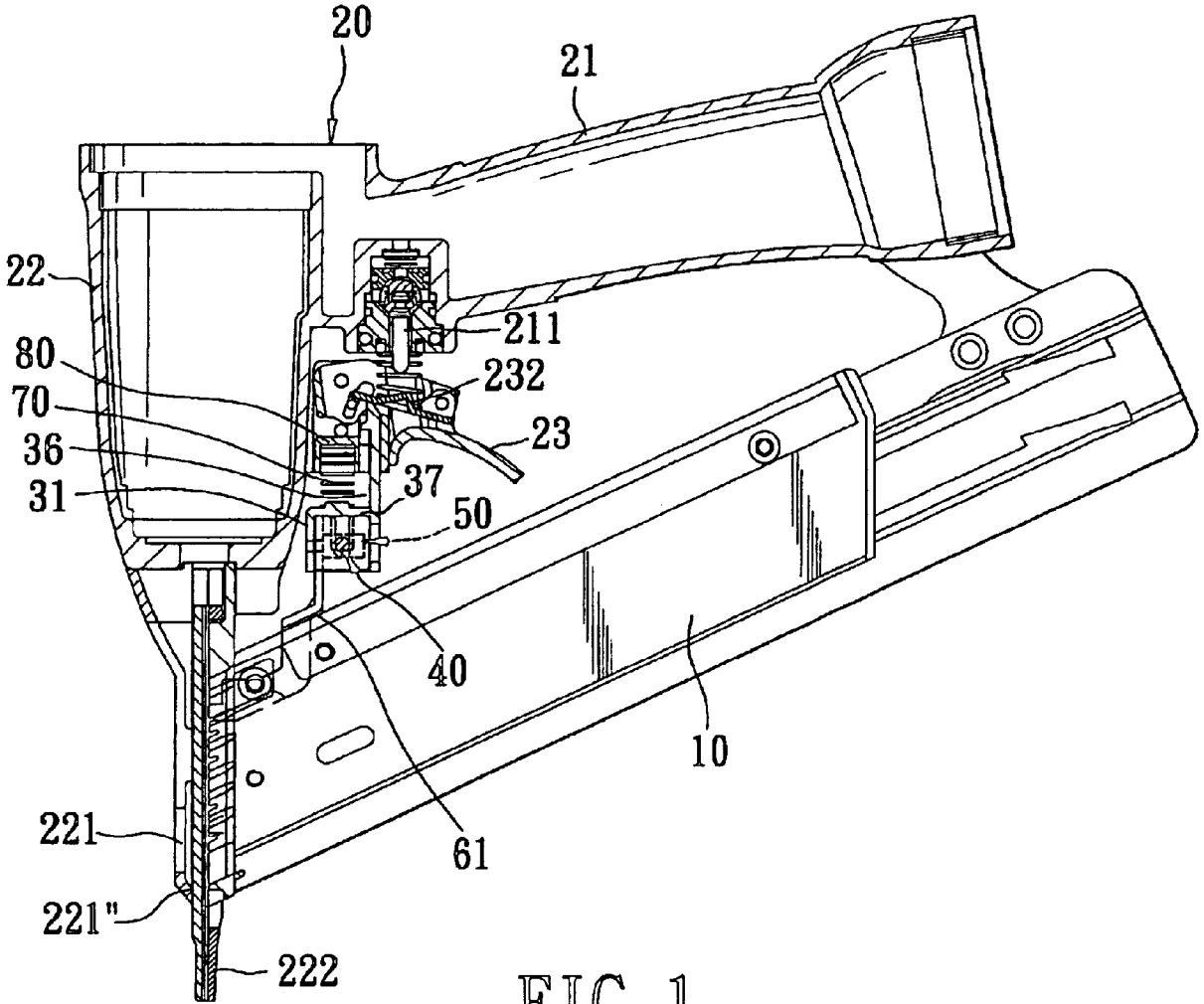
FIG. 1 is a schematic partly sectional view of a powered fastener driving tool which is provided with the preferred embodiment of a depth control device of the present invention.
Figure 2:
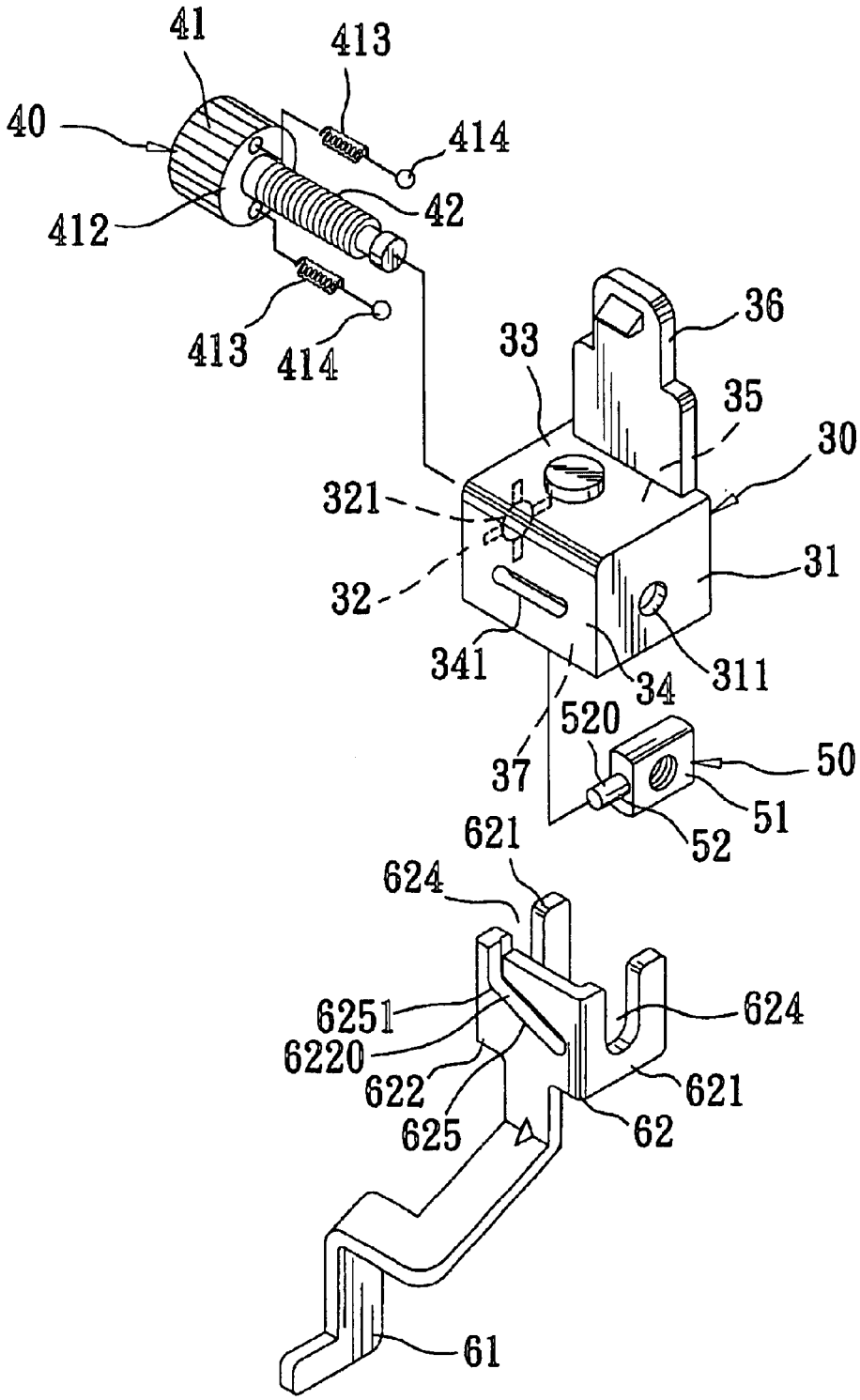
FIG. 2 is an exploded perspective view the preferred embodiment of the depth control device of the present invention.
Figure 3:
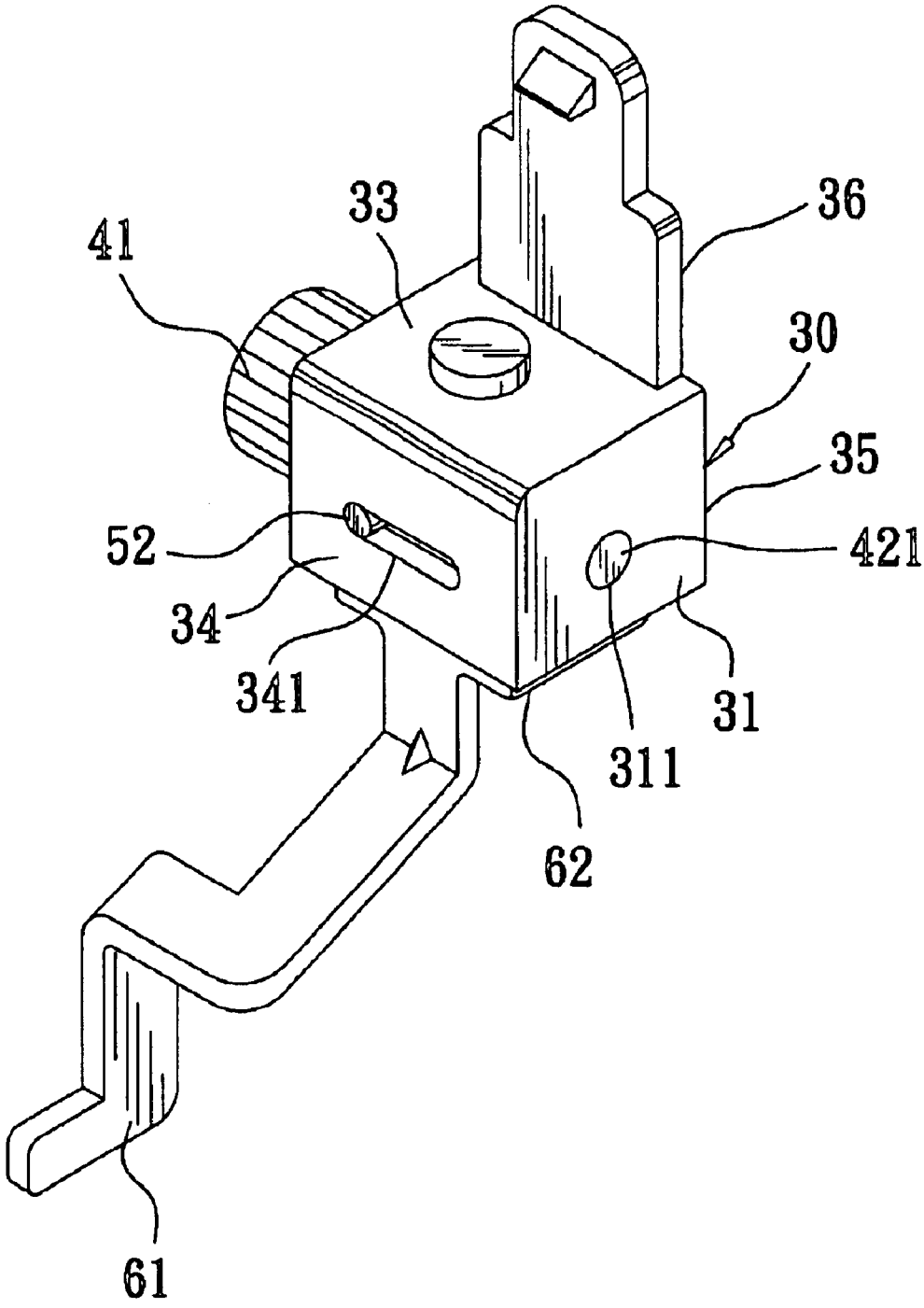
FIG. 3 is a perspective view of the preferred embodiment of the depth control device in an assembled state.
Figure 4:
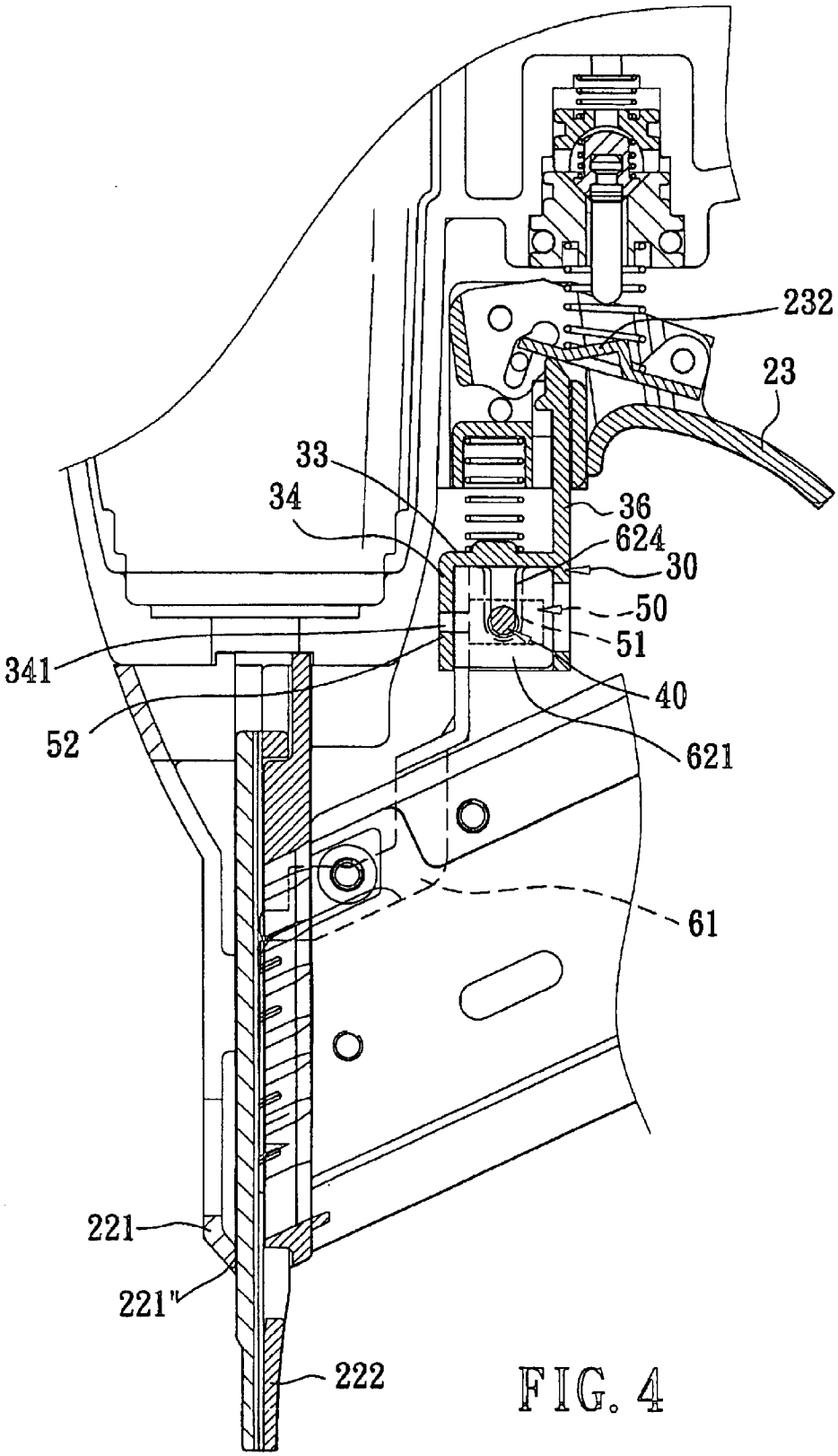
FIG. 4 is an enlarged fragmentary, partly sectional view to illustrate how the depth control device of FIG. 3 is connected to a trigger of the powered fastener driving tool.

Referring to FIGS. 1 to 4, the preferred embodiment of a depth control device according to the present invention is used in a powered fastener driving tool 20 which includes a main body 22, a handgrip portion 21 extending laterally from the main body 22, a trigger 23 mounted on the handgrip portion 21, an actuator 232 disposed movably in the handgrip portion 21 and associated with the trigger 23 for actuating the driving tool 20 upon pulling of the trigger 23, a fastener guiding body 221 extending frontwardly and outwardly from the main body 22 in a longitudinal direction and formed with a fastener-discharging end 221", and a workpiece contact element 222 disposed frontwardly of the fastener-discharging end 221" and connected movably to the fastener guiding body 221. The workpiece contact element 222 is associated with the actuator 232 and is movable relative to the fastener guiding body 221 in the longitudinal direction between a non-actuated position, in which the driving tool 20 cannot be actuated by the actuator 232 upon pulling of the trigger 23, and an actuated position, in which the driving tool 20 is actuated by the actuator 232 upon pulling of the trigger 23. The fastener guiding body 221 is adapted to receive fasteners (not shown) which are fed successively and continuously thereinto from a cartridge 10 that is detachably connected to the fastener guiding body 221. Since the relevant feature of the present invention does not reside in the construction of the cartridge 10 and the driving tool 20, a detailed description thereof is omitted herein for the sake of brevity.

Figure 5:
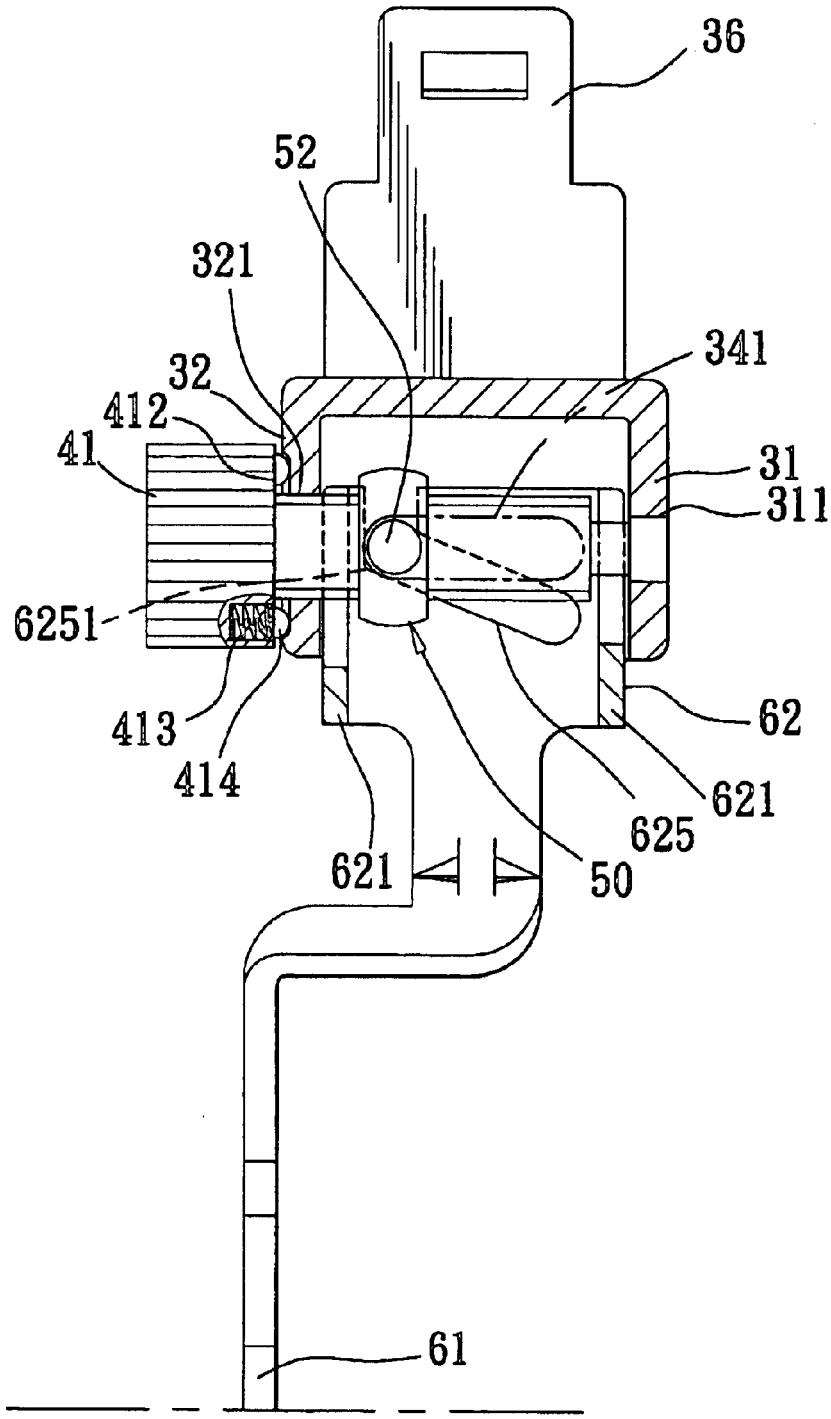
FIGS. 5 and 6 are fragmentary views to illustrate how the position of a workpiece contact element is adjusted through the depth control device of FIG. 3.
Figure 6:
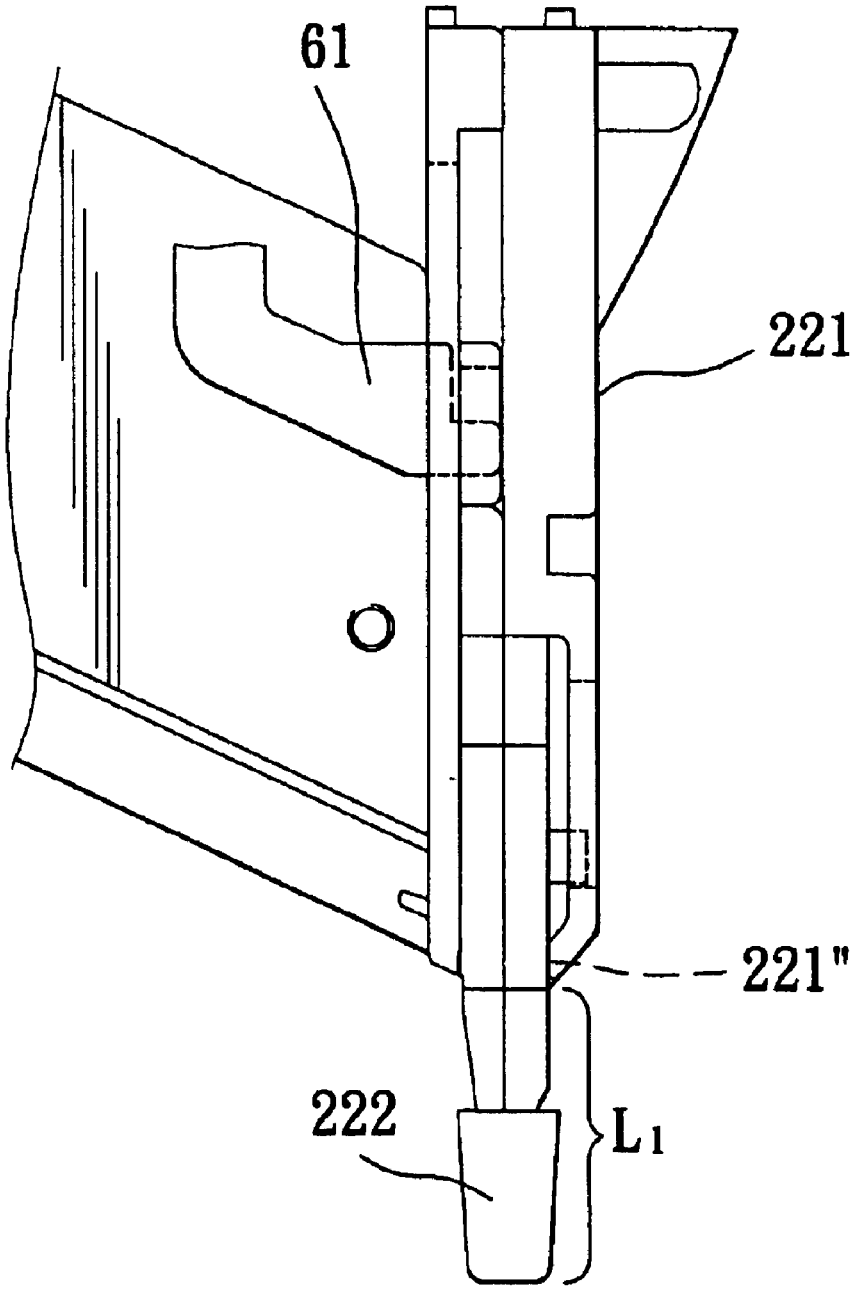
Figure 7:
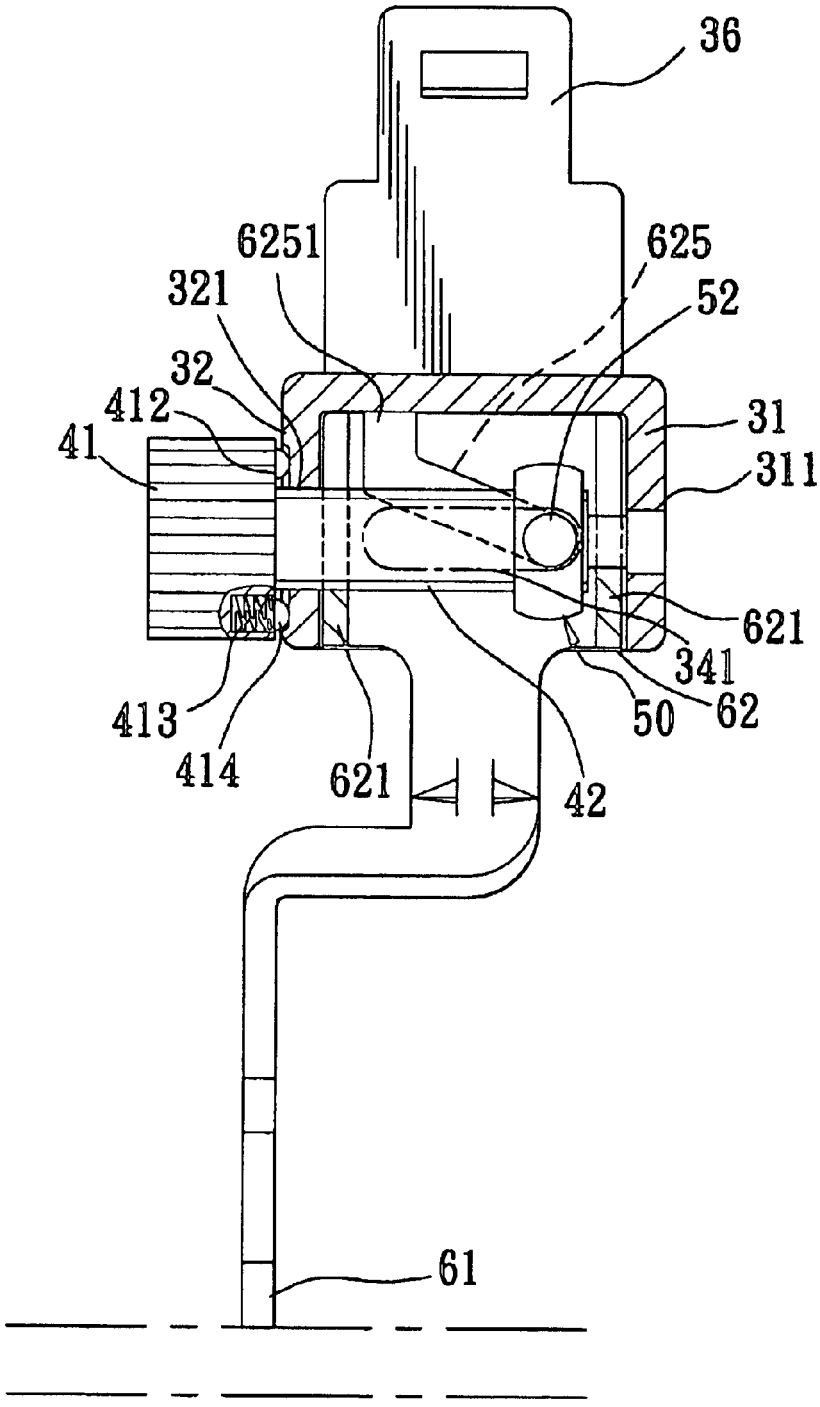
FIGS. 7 and 8 are fragmentary, partly sectional views to illustrate the positions of the workpiece contact element corresponding to FIGS. 5 and 6, respectively.
Figure 8:
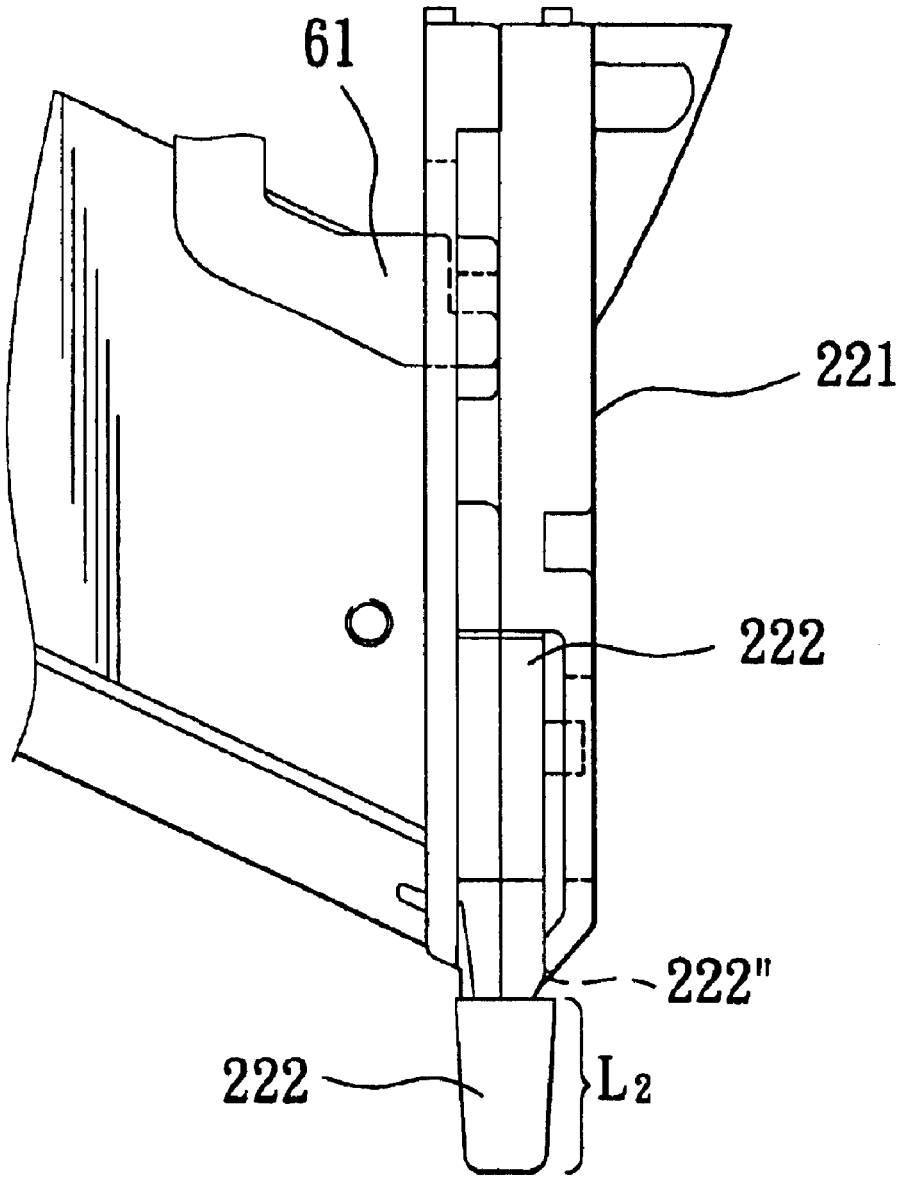

The preferred embodiment includes a linkage 61, a driving member 40, a cam unit, a push member 36, an urging member 70, and a mounting case 30. The linkage 61 is connected to the workpiece contact element 222 of the driving tool 20 in a known manner so as to be movable together therewith in the longitudinal direction. The cam unit is mounted in the main body 22 of the driving tool 20, and includes a cam 50 and a cam follower 62. The cam 50 defines a first cam face 520. The cam follower 62 defines a second cam face 6220. The cam follower 62 is connected to the linkage 61 so as to be movable together with the linkage 61 and the workpiece contact element 222 in the longitudinal direction between first and second longitudinal positions relative to the cam 50 when the workpiece contact element 222 is disposed at the non-actuated position. The cam 50 is connected to the driving member 40 which is operable to drive the cam 50 to move in a transverse direction relative to the longitudinal direction between first and second transverse positions relative to the cam follower 62. The first cam face 520 of the cam 50 and the second cam face 6220 of the cam follower 62 engage each other slidingly and in such a manner as to permit movement of the cam follower 62 together with the linkage 61 and the workpiece contact element 222 between the first longitudinal position (see FIGS. 5 and 6), where the front end of the workpiece contact element 222 is spaced apart from the fastener discharging end 221" by a distance L1, and the second longitudinal position (see FIGS. 7 and 8), where the front end of the workpiece contact element 222 is spaced apart from the fastener discharging end 221" by a distance L2 that is shorter than L1, when the cam 50 is driven by the driving member 40 to move between the first transverse position (see FIG. 5) and the second transverse position (see FIG. 7). The cam follower 62 is further movable together with the linkage 61, the cam 50 and the driving member 40 from an adjusted position between the first and second longitudinal positions to a third longitudinal position in the longitudinal direction upon movement of the workpiece contact element 222 from the non-actuated position to the actuated position.

The push member 36 contacts the actuator 232, and is associated with the cam 50 in such a manner as to be movable together therewith in the longitudinal direction upon movement of the workpiece contact element 222 between the non-actuated position and the actuated position.

The urging member 70 is secured to a mounting seat 80 (see FIG. 1) that is formed on the main body 22 for urging and thus restoring the cam follower 62 together with the cam 50 and the linkage 61 from the third longitudinal position to the adjusted position between the first and second longitudinal positions, which, in turn, results in restoring of the workpiece contact element 222 from the actuated position to the non-actuated position.

The driving member 40 includes a screw rod 42 and a turning knob 41. The screw rod 42 extends in the transverse direction. The turning knob 41 is fixed co-axially to one end of the screw rod 42. The cam 50 preferably includes a block 51 that engages threadedly the screw rod 42, and a protrusion 52 that protrudes from the block 51 and that has an outer surface defining the first cam face 520.

The cam follower 62 has a camming part 622 and two opposite side parts 621. The camming part 622 is connected to the linkage 61 and is formed with an inclined slot 625 which is inclined relative to the transverse direction and which is defined by a slot-defining wall 6251. The slot-defining wall 6251 defines the second cam face 6220 of the cam follower 62. The protrusion 52 of the cam 50 extends through the inclined slot 625 in such a manner that the outer surface of the protrusion 52 of the cam 50 is in sliding contact with the slot-defining wall 6251 of the inclined slot 625.

The mounting case 30 is disposed frontwardly of and is connected to the push member 36, and defines a chamber 37 to receive the cam 50 and the cam follower 62 therein. The mounting case 30 has spaced-apart side walls 31, 32 that are respectively formed with rod-mounting holes 311, 312, first and second lateral walls 34, 35 interconnecting the side walls 31, 32, and a rear wall 33 interconnecting the side walls 31, 32 and the first and second lateral walls 34, 35. The rear wall 33 is formed with a spring-holding post which holds one end of the urging member 70. The first lateral wall 34 of the mounting case 30 is formed with a lateral slot 341 extending in the transverse direction. The screw rod 42 extends rotatably through the rod-mounting holes 311, 312 in the side walls 31, 32 of the mounting case 30. The protrusion 52 of the cam 50 extends through the lateral slot 341 in the mounting case 30 in such a manner that rotation of the screw rod 42 results in movement of the cam 50 on the screw rod 42 in the transverse direction.

The side parts 621 of the cam follower 62 extend transversely and respectively from two opposite sides of the camming part 622, and are disposed respectively adjacent to the side walls 31, 32 of the mounting case 30 in such a manner as to prevent wobbling of the cam follower 62 in the transverse direction during movement of the cam follower 62 in the longitudinal direction. The side parts 621 of the cam follower 62 are further formed with retaining grooves 624 for extension of the screw rod 42 therthrough.

Preferably, two sets of spring-biased balls 413, 414 are disposed between and abut resiliently against an inner face 412 of the turning knob 41 and the side wall 32 of the mounting case 30, thereby preventing undesired and untimely rotation of the screw rod 42 on the mounting case 30.

In operation, when the workpiece contact element 222 is abutted against a workpiece (not shown), the workpiece contact element 222 is moved to the actuation position, thereby resulting in movement of the cam follower 62 to the third longitudinal position, which, in turn, results in compression of the urging member 70 and movement of the push member 36 to cause the actuator 232 to move toward a valve rod 211 (see FIG. 1) of the driving tool 20 so as to permit activation of the driving tool 20 upon pulling of the trigger 23. Since the force of the driving tool 20 for driving each of the fasteners is constant and since the distance between the fastener discharging end 221" and the workpiece (not shown) can be varied by adjusting the position of the workpiece contact element 222, i.e., the position of the cam follower 62 relative to the cam 50, a desired depth of penetration of the fastener into the workpiece can be achieved.

Rotation of the screw rod 42 of the driving member 40 of the depth control device according to the present invention can be easily conducted in order to adjust the depth of drive for the driving tool 20. In addition, since no spring is used for preventing undesired rotation of the driving member 40 in the present invention, the aforesaid spring fatigue problem associated with the prior art is accordingly eliminated.

With this invention thus explained, it is apparent that numerous modifications and variations can be made without departing from the scope and spirit of this invention. It is therefore intended that the invention be limited only as indicated in the appended claims.

I claim:

1. A depth control device for a fastener driving tool that includes a trigger, an actuator disposed movably therein and associated with the trigger for actuating the driving tool upon pulling of the trigger, a fastener guiding body, and a workpiece contact element associated with the actuator and movable relative to the fastener guiding body in a longitudinal direction between a non-actuated position, in which the driving tool cannot be actuated by the actuator upon pulling of the trigger, and an actuated position, in which the driving tool is actuated by the actuator upon pulling of the trigger, said depth control device comprising:

a linkage adapted to be connected to the workpiece contact element so as to be movable together therewith in the longitudinal direction;

a driving member;

a cam unit adapted to be mounted in the driving tool and including a cam that defines a first cam face, and a cam follower that defines a second cam face, said cam follower being connected to said linkage so as to be movable together with said linkage and the workpiece contact element in the longitudinal direction between first and second longitudinal positions relative to said cam when the workpiece contact element is disposed at the non-actuated position, said cam being connected to said driving member, which is operable to drive said cam to move in a transverse direction relative to the longitudinal direction between first and second transverse positions relative to said cam follower, said first and second cam faces engaging each other slidingly and in such a manner as to permit movement of said cam follower together with said linkage and the workpiece contact element between said first longitudinal position and said second longitudinal position when said cam is driven by said driving member to move between said first transverse position and said second transverse position, said cam follower being movable together with said linkage, said cam and said driving member from an adjusted position between said first and second longitudinal positions to a third longitudinal position in the longitudinal direction upon movement of the workpiece contact element from the non-actuated position to the actuated position; and a push member adapted to contact the actuator and associated with said cam in such a manner as to be movable together therewith in the longitudinal direction upon movement of the workpiece contact element between the non-actuated position and the actuated position.

2. The depth control device as defined in claim 1, further comprising an urging member for urging said cam follower to move together with said cam and said linkage from said third longitudinal position to said adjusted position between said first and second longitudinal positions, which, in turn, results in restoration of the workpiece contact element from the actuated position to the non-actuated position.

3. The depth control device as defined in claim 2, wherein said driving member includes a screw rod extending in said transverse direction, said cam including a block that engages threadedly said screw rod, and a protrusion protruding from said block and having an outer surface that defines said first cam face.

4. The depth control device as defined in claim 3, wherein said cam follower has a camming part that is connected to said linkage and that is formed with an inclined slot which is inclined relative to said transverse direction and which is defined by a slot-defining wall, said slot-defining wall defining said second cam face, said protrusion of said cam extending through said inclined slot in such a manner that said outer surface of said protrusion of said cam is in sliding contact with said slot-defining wall of said inclined slot.

5. The depth control device as defined in claim 4, further comprising a mounting case that is connected to said push member, that defines a chamber to receive said cam and said cam follower therein, and that has spaced-apart side walls which are respectively formed with rod-mounting holes and a lateral wall interconnecting said side walls and formed with a lateral slot extending in said transverse direction, said screw rod extending rotatably through said rod-mounting holes in said side walls, said protrusion of said cam extending through said lateral slot in said mounting case in such a manner that rotation of said screw rod results in movement of said cam on said screw rod in said transverse direction.

6. The depth control device as defined in claim 5, wherein said cam follower further includes two opposite side parts extending transversely and respectively from two opposite sides of said camming part, and is formed with two opposite retaining grooves in said side parts for extension of said screw rod therthrough.

7. The depth control device as defined in claim 6, wherein said driving member further includes a turning knob connected co-axially to said screw rod and a pair of spring-biased balls disposed between and abutting resiliently against said turning knob and one of said side walls of said mounting case.

* * * * *